United States Patent [19]

Widman

[11] 3,930,646

[45] Jan. 6, 1976

[54] TENNIS NOVELTY

[76] Inventor: Marshall A. Widman, 443 W. 104th St., Apt. B, Kansas City, Mo. 64114

[22] Filed: Dec. 11, 1974

[21] Appl. No.: 531,537

[52] U.S. Cl. ..... 272/1 R; 273/85 A; 273/85 E

[51] Int. Cl.[2] ..... A63G 31/00; A63F 7/06

[58] Field of Search ..... 273/95 AA, 95 A, 85 R, 273/85 A, 85 E, 26 EA, 26 E; 46/245, 148, 1 R, 1 B, 1 C, 1 E, 1 M; 272/1 R, 1 A, 1 B, 1 C

[56] References Cited

UNITED STATES PATENTS

| | | | |
|---|---|---|---|
| 1,853,620 | 4/1932 | Johnson | 273/1 R UX |
| 2,167,847 | 8/1939 | Olken | 273/85 E |

FOREIGN PATENTS OR APPLICATIONS

| | | | |
|---|---|---|---|
| 957,117 | 8/1949 | France | 273/85 R |
| 1,035,760 | 4/1953 | France | 46/148 |
| 1,155,495 | 6/1969 | United Kingdom | 273/85 A |
| 508,532 | 1/1955 | Italy | 273/85 A |
| 684,384 | 3/1965 | Italy | 273/85 R |

*Primary Examiner*—Richard C. Pinkham
*Assistant Examiner*—Arnold W. Kramer
*Attorney, Agent, or Firm*—D. A. N. Chase

[57] ABSTRACT

An amusement device simulates the game of tennis and has a miniature playing surface provided with the lines and net that characterize a tennis court. Hitting elements representing opposing players are disposed on opposite sides of the net, and a wire extends over the net and has its ends anchored near the respective elements. The wire simulates the path of a ball, and a bead is threaded on the wire to represent the ball. The two hitting elements are mounted for oscillation about upright axes, and a cam-operated spring drive alternately actuates the elements in a manner to strike the bead and propel it back and forth over the net to simulate the action in tennis.

7 Claims, 3 Drawing Figures

TENNIS NOVELTY

This invention relates to a game action novelty and, in particular, to an amusement device which simulates the game of tennis.

The game of tennis has grown rapidly in popularity in recent years, both as to the number of people who play the game and the spectators who are tennis fans. Accordingly, novelty items relating to tennis are of increasing interest, just as with the game of golf several years ago.

It is, therefore, the primary object of this invention to provide an action novelty relating to the game of tennis, which is enjoyable and interesting to watch and which may be manufactured at reasonable cost as a gift item for tennis enthusiasts.

It is also an important object of this invention to provide a novelty as aforesaid in the nature of an amusement device which simulates the game of tennis by propelling a projectile, representing a tennis ball, back and forth over the net of a miniature playing court.

Still another important object of this invention is to provide a novelty as aforesaid for tennis and similar games such as badminton, wherein the path of the projectile used to play the game is defined by a wire extending above the miniature playing surface over the net, and wherein the projectile slides along the wire and is guided thereby as it is propelled back and forth by opposed hitting elements that simulate the players.

Yet another important object of this invention is to provide a novelty as aforesaid wherein the projectile is in the form of a bead threaded on the wire, the hitting elements being alternately actuated to propel the bead back and forth across the net to create an interesting and amusing effect.

Figure 1:
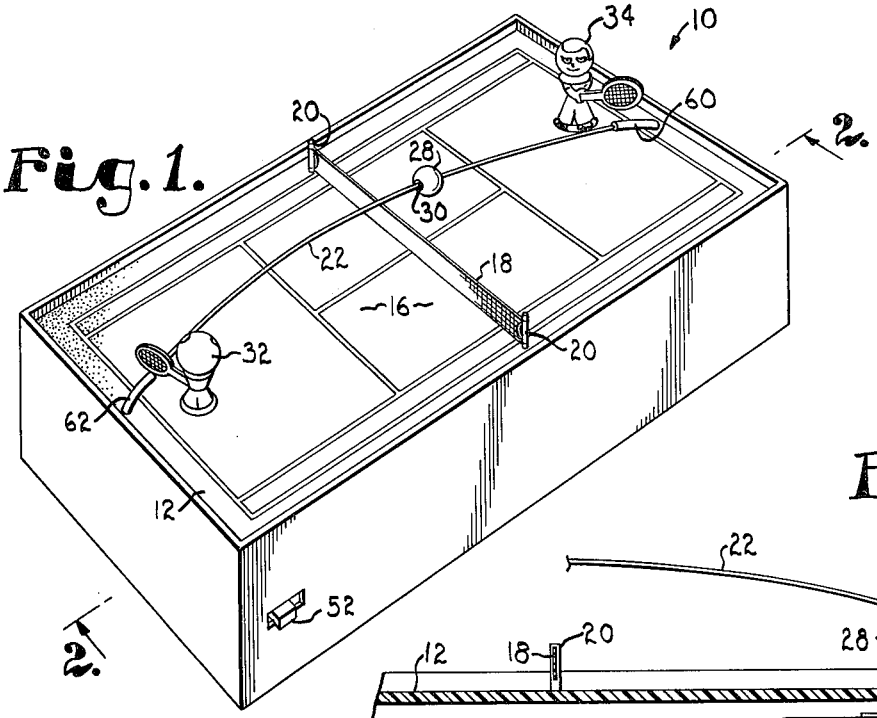
FIG. 1 is a perspective view of the amusement device of the present invention.

The numeral 10 broadly denotes a rectangular housing having a top 12 which is slightly recessed and a bottom 14 which is recessed to a greater degree. The rectangular upper surface 16 of the top 12 has lines thereon representing the base lines, sidelines, service courts and alleys of a tennis court; accordingly, a miniature playing surface is presented that simulates the appearance of a tennis court. A miniature net 18 is strung between a pair of posts 20 centered adjacent the longitudinal edges of the top 12 to thereby complete the court configuration.

Figure 2:
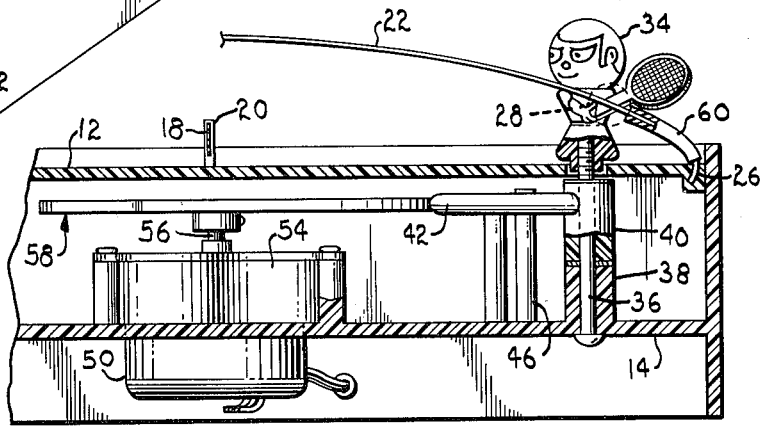
FIG. 2 is an enlarged, fragmentary, vertical sectional view taken along line 2—2 of FIG. 1, certain interior components being shown partially in section for clarity.

A wire 22 extends above the surface 16 and over the net 18 to simulate the path of a projectile used to play the game. The wire 22 has opposed ends 24 and 26 embedded in the top 12 at the transverse edges thereof, as is clear in FIG. 2 with respect to end 26. The top 12 as well as the bottom 14 and side and end panels of the housing 10 may be of plastic construction, in which case the ends 24 and 26 are embedded in the top 12 as seen in FIG. 2 to firmly anchor the ends in place. The wire 22 is upwardly flexed and bowed to clear the net 18 and remains in place since the ends 24 and 26 are fixed.

The projectile is a bead 28 of any suitable material such as wood or plastic, and is threaded on the wire 22 as illustrated. Preferably to represent a tennis ball, the bead 28 is round and has a central opening 30 therethrough of sufficiently greater diameter than the wire 22 to render the bead 28 freely slidable thereon.

A pair of hitting elements 32 and 34 are mounted on the surface 16 and, as shown, are configured to represent players equipped with tennis rackets. The elements 32 and 34 are amusing characterizations of tennis players in action and are each oscillated about an upright axis during operation of the device, as will be explained.

Referring particularly to FIG. 2, the mounting for the element 34 is shown in detail (an identical arrangement being employed for the element 32). A rotatable, vertical pivot pin in the nature of a bolt extends upwardly through a boss 38 on the bottom 14, the threads thereof being received by mating internal threads within the element 34. A clearance opening in the top 12 for the pin 36 and the lower end of the element 34 permits the element 34 and pin 36 to pivot freely as a unit. A spacer 40 is slipped over the pin 36 and may be fixed thereto by an interference fit, the spacer 40 being disposed between the boss 38 and the top 12 along with washers at its upper and lower ends as illustrated. A cam follower arm 42 extends radially outwardly from the spacer 40 and is connected with a drive spring 44 as is clear in FIG. 3. An upright stop pin 46 projects from the bottom 14 and limits the movement of the follower arm 42 under the action of the spring 44. Regarding element 32, the cam follower arm therefor is illustrated in broken lines at 48 in FIG. 3.

A small electric motor 50 is mounted on the underside of the recessed bottom 14 and is controlled by an on/off switch 52 in the usual manner. The output of the motor 50 is connected to a gear reduction drive 54 having an output shaft 56. A cam 58 is secured to the shaft 56 and has three lobes **58*a*, 58*b* and 58*c*** spaced at 120° intervals.

In order to hold the bead 28 at a rest position where it may be struck by the simulated racket of the element 34, a sleeve 60 is slipped over the end 26 of the wire 22 to serve as a stop, as best seen in FIG. 2 where the bead 28 is illustrated in broken lines. The diameter of the sleeve 60 is significantly greater than that of the opening 30 in the bead 28, thereby positively retaining the bead in the position illustrated. Likewise, a stop sleeve 62 is disposed on the other end 24 of the wire 22.

OPERATION

Figure 3:
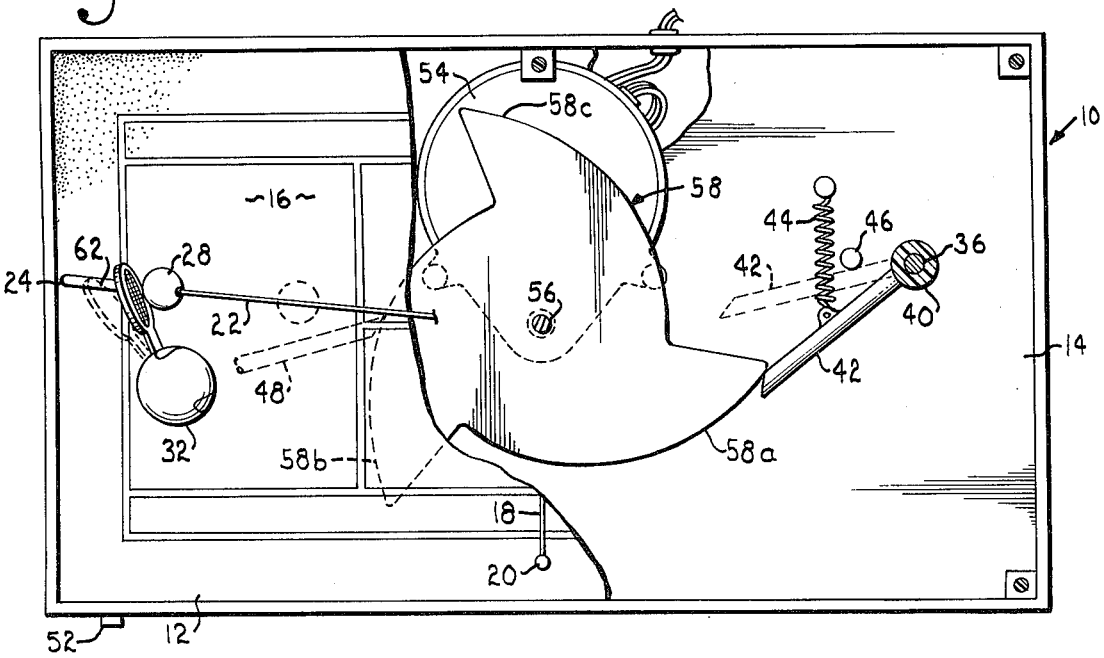
FIG. 3 is a plan view of the device on the same scale as FIG. 2, a major portion of the recessed top of the housing being broken away to reveal the drive mechanism.

Upon energization of the motor 50, the cam 58 rotates in a clockwise direction as viewed in FIG. 3. The broken line illustration of follower arm 42 shows the same against the stop pin 46; in FIG. 3, the cam lobe **58*a* has shifted the follower arm 42 to the full line position illustrated and is about to move out of engagement therewith. Viewing FIGS. 1 and 2, the hitting element 34 has been correspondingly rotated to a position where the simulated racket is drawn back in readiness for striking the bead 28 once the cam lobe 58*a* moves past the arm 42. When this occurs, the element 42 is released for return movement in the opposite rotative direction under the action of the drive spring 44, thereby striking the bead 28 with sufficient force to propel it along the wire 22** toward the other element 32. (In FIG. 1, the bead 28 is depicted in flight at a time just after release of the element 34 for return movement under the force of the spring 44.)

While the lobe 58*a* is attenuating the spring 44 by engagement with the follower arm 42, the follower arm 48 is aligned with the beginning of the arcuate ramp of the lobe 58*b* and, therefore, the position of the simulated racket of element 32 is as illustrated in FIG. 3. The bead 28 is shown in contact with the front of the racket in order to illustrate the relative positions of the parts after the bead 28 is propelled by the element 34 (which is about to happen). Now, assuming a slight additional clockwise displacement of the cam 58 from that shown in FIG. 3, the follower arm 42 is released as discussed above and the bead 28 is struck by the element 34 and propelled across the net to the position shown in FIG. 3 where it is now ready to be returned by the element 32. As the cam 58 continues to rotate, the lobe 58*b* engages the follower arm 48 and swings it in a counterclockwise direction as viewed in FIG. 3, thereby attentuating the drive spring (not shown) associated with the hitting element 32. The broken line illustration of the racket of element 32 shows its position when fully rotated by the cam lobe 58*b* just prior to disengagement and release. Accordingly, it may be appreciated that the hitting elements 32 and 34 are alternatively actuated by the drive mechanism so that the device simulates the action in tennis when the players are volleying.

It is important to note that the bead 28 at the ends of its path of travel ultimately come to rest against the sleeves 60 and 62. As the simulated racket of each element 32 or 34 is rotated rearwardly, the bead 28 comes to rest against the associated sleeve and is held in the proper position to be crisply struck by the racket and propelled back across the net.

To create an interesting novelty, it is important that the hitting elements 32 and 34 be actuated at a sufficient frequency. For example, with output shaft 56 turning at a speed of 8 rpm, 24 hits per minute are executed by each element for a total of 48 hits per minute. The shaft speed may, of course, be increased if a very fast action is desired.

Having thus described the invention, what is claimed as new and desired to be secured by Letters Patent is:

1. Game novelty apparatus comprising:

structure provided with a miniature playing surface having means thereon which causes the surface to simulate the court or field on which a game is played;

a miniature net secured to said structure and extending across said surface thereabove;

a pair of hitting elements on said surface simulating players of said game, one on each side of said net;

a wire-like member secured at each end to said structure and extending above said surface over said net to simulate the path of a projectile used to play said game;

a component slidable on said member and representing said projectile;

means mounting each element for movement in a direction causing the component to be struck by the element and propelled along the member away from a position of the component on the member adjacent the element; and drive means coupled with said elements for automatically alternately actuating the latter to cause the component to be propelled back and forth over the net, whereby to simulate the action in said game.

2. The apparatus as claimed in claim 1, wherein said member has a pair of opposed ends fixed to said structure behind the respective elements.

3. The apparatus as claimed in claim 1, wherein said component has an opening therethrough receiving said member for free sliding movement of the component therealong.

4. The apparatus as claimed in claim 1, wherein said component is a bead threaded on said member.

5. The apparatus as claimed in claim 1, further comprising a stop on said member adjacent each of said elements respectively and defining said position of the component adjacent the corresponding element.

6. The apparatus as claimed in claim 5, wherein said component has an opening therethrough receiving said member for free sliding movement of the component therealong, said member having a pair of opposed ends fixed to said structure behind the respective elements, and wherein said stops comprise a pair of sleeves on said ends of the member of greater diameter than said opening.

7. The apparatus as claimed in claim 1, wherein said mounting means supports each element for oscillation about an upright axis, and wherein said drive means includes a pair of cam followers connected with respective elements, a rotatable cam engageable with said followers, drive spring means coupled with each of said elements, and means for rotating said cam to alternately swing each element against the action of its said spring means and release the element upon disengagement of the cam with the associated follower for return movement of the element in said direction under the action of its spring means.

* * * * *